US008952777B2

(12) United States Patent
Weber et al.

(10) Patent No.: US 8,952,777 B2
(45) Date of Patent: Feb. 10, 2015

(54) TRANSFORMER WINDING

(71) Applicant: ABB Technology AG, Zürich (CH)

(72) Inventors: Benjamin Weber Weber, Winterberg (DE); Bhavesh Patel, Brilon (DE); Burak Esenlik, Paderborn (DE); Frank Cornelius, Olsberg (DE); Marcos Bockholt, Paderborn (DE); Jens Tepper, Brilon (DE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 13/785,306

(22) Filed: Mar. 5, 2013

(65) Prior Publication Data

US 2013/0181796 A1 Jul. 18, 2013

Related U.S. Application Data

(63) Continuation of application No. PCT/EP2011/003669, filed on Jul. 22, 2011.

(30) Foreign Application Priority Data

Sep. 8, 2010 (EP) ..... 10175699

(51) Int. Cl.

| | |
|---|---|
| ***H01F 27/36*** | (2006.01) |
| ***H01F 27/32*** | (2006.01) |
| ***H01F 27/08*** | (2006.01) |
| ***H01F 27/28*** | (2006.01) |

(52) U.S. Cl.

CPC ..... *H01F 27/085* (2013.01); *H01F 27/2885* (2013.01); *H01F 27/362* (2013.01)

USPC ..... 336/84 R; 336/60; 336/61; 336/84 C; 336/84 M

(58) Field of Classification Search

USPC ..... 336/84 R, 84 C, 84 M, 55, 60, 61

See application file for complete search history.

(56) References Cited

U.S. PATENT DOCUMENTS

| | | | | |
|---|---|---|---|---|
| 2,553,324 | A * | 5/1951 | Lord | 336/73 |
| 4,663,603 | A * | 5/1987 | van Riemsdijk et al. | 336/60 |

(Continued)

FOREIGN PATENT DOCUMENTS

| | | | |
|---|---|---|---|
| DE | 1258966 | B | 1/1968 |
| GB | 829983 | A | 3/1960 |
| WO | WO 2006/103193 | A2 | 10/2006 |

OTHER PUBLICATIONS

International Search Report (PCT/ISA/210) issued on Sep. 1, 2011, by the European Patent Office as the International Searching Authority for International Application No. PCT/EP2011/003669.

*Primary Examiner* — Tsz Chan

(74) *Attorney, Agent, or Firm* — Buchanan Ingersoll & Rooney PC

(57) ABSTRACT

A transformer winding, having at least two multi-layered winding modules, which are connected electrically in series, extend about a common winding axis, and are nested one inside the other hollow-cylindrically, at least one cooling channel, which is arranged along the common winding axis hollow-cylindrically between the winding modules, and a flat electrical shield is provided within the at least one cooling channel at least sectionally along the radial circumference thereof, wherein the electrical shield extends over approximately the entire axial length and through which electrical shield the electrical capacitance distribution in the transformer winding connected electrically in series is influenced.

16 Claims, 2 Drawing Sheets

(56) References Cited

U.S. PATENT DOCUMENTS 5,107,411 A * 4/1992 Misdom ..... 363/20
2008/0211611 A1 9/2008 Hanov
2011/0074533 A1* 3/2011 Phadke ..... 336/150

* cited by examiner

TRANSFORMER WINDING

RELATED APPLICATIONS

This application is a continuation under 35 U.S.C. §120 to International Application PCT/EP2011/003669 filed on Jul. 22, 2011, designating the U.S. and claiming priority to application 10175699.7 filed in Europe on Sep. 8, 2010. The content of each application is hereby incorporated by reference in its entirety.

FIELD

The disclosure relates to a transformer winding, having at least two multi-layered winding modules, which are connected electrically in series, extend about a common winding axis, are nested one inside the other hollow-cylindrically, and having at least one cooling channel, which is arranged along the same winding axis hollow-cylindrically between the winding modules.

BACKGROUND INFORMATION

It is known that power transformers, for example with a rated power of a few MVA and in a voltage range of 5 kV to 30 kV or 110 kV, sometimes even up to 170 kV, for example, are also in the form of dry-type transformers, wherein, in the last-mentioned voltage range, rated powers of 50 MVA and above are also entirely possible. During operation of a transformer, lost heat is produced in the electrical windings of the transformer, and this lost heat should be dissipated to the surrounding environment. Therefore, at least one cooling channel guided along the axial extent of the winding is developed in order to pass the lost heat, e.g., by means of natural air cooling, out of the winding interior, in order to cool such a dry-type transformer. In order to increase the cooling effect the radially inner low-voltage winding is divided into a plurality of radially spaced-apart, hollow-cylindrical winding segments which are connected electrically in series and between which a likewise hollow-cylindrical cooling channel is arranged.

However, one disadvantage with this is that the (stray) capacitance of the interconnected winding is no longer distributed approximately homogeneously amongst the individual winding turns, but instead a region with a low capacitance is developed in the region of the cooling channel. The result can be realized in dry-type transformers because the cooling channels provided there have a thickness of a few centimeters. On the other hand, in oil-filled transformers, the thickness of the cooling channels is in the millimeters range, with the result that the capacitive change in the winding is correspondingly small.

This effect can be important under the conditions of surge voltage loading of the winding, e.g., in the case of a voltage pulse entering from the outside at the terminals of the winding, for example with a rise time in the μs range. Owing to the high-frequency fundamental component of such a voltage pulse, the voltage is distributed along the individual turns of the winding corresponding to the respective capacitance thereof. Since the capacitance is now distributed non-uniformly owing to the introduction of the cooling channel, a disadvantageous non-uniform voltage loading of the conductor also results, which conductor can be designed for the same voltage loading over its entire length.

Against the background of this prior art, the object of the disclosure is to specify a transformer winding with a homogenized voltage distribution in the case of surge voltage loading.

SUMMARY

An exemplary transformer winding is disclosed, comprising: at least two multi-layered winding modules, which are connected electrically in series, extend about a common winding axis, and are nested one inside the other hollow-cylindrically; at least one cooling channel, which is arranged along the common winding axis hollow-cylindrically between the winding modules; and a flat electrical shield is provided within the at least one cooling channel at least sectionally along the radial circumference thereof, wherein the electrical shield extends over approximately the entire axial length and through which electrical shield the electrical capacitance distribution in the transformer winding connected electrically in series is influenced.

An exemplary transformer winding is disclosed, comprising: a plurality of multi-layered winding modules connected electrically in series, each winding module is formed as first hollow-cylinders extending about a common winding axis, wherein a first winding module is nested inside a second winding module; at least one cooling channel, which is arranged in a second hollow-cylinder along the common winding axis and between the first and second winding modules; and a flat electrical shield is provided within the at least one cooling channel and at least sectionally along a radial circumference of the at least one cooling channel, wherein the electrical shield extends over approximately an entire axial length of the at least one cooling channel and influences the electrical capacitance distribution in the series-connected winding modules.

BRIEF DESCRIPTION OF THE DRAWINGS

The disclosure, further embodiments and further advantages will be described in more detail with reference to exemplary embodiments illustrated in the drawings, in which.

DETAILED DESCRIPTION

Figure 1:
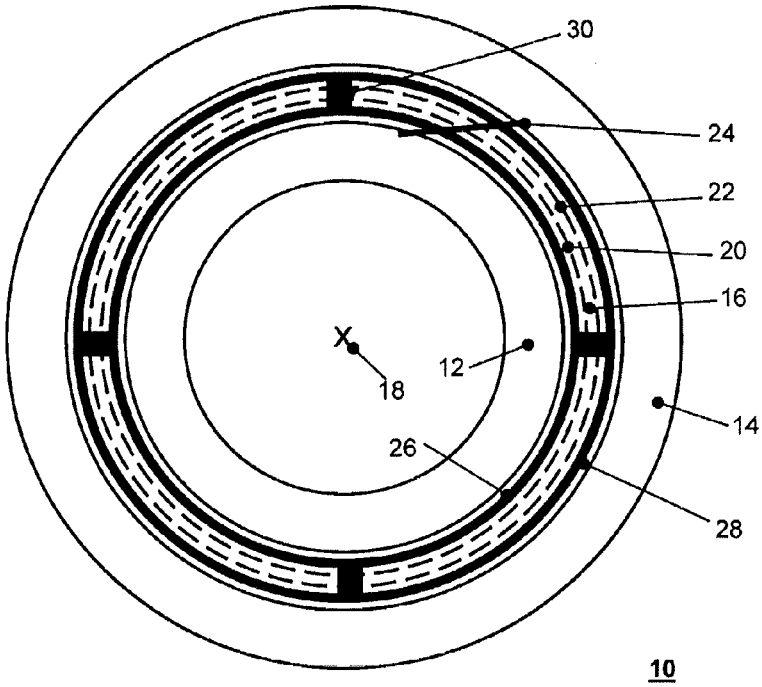
FIG. 1 shows a plan view of a first transformer winding in accordance with an exemplary embodiment of the present disclosure.

Exemplary embodiments of the present disclosure are directed to a transformer winding of the type mentioned at the outset. This transformer winding includes a flat electrical shield in the at least one cooling channel at least sectionally along the radial circumference thereof, which electrical shield extends over approximately the entire axial length, and by means of which electrical shield the electrical capacitance distribution in the transformer winding connected electrically in series is influenced.

Exemplary embodiments described herein provide the hollow-cylindrical interior of the at least one cooling channel, which usually extends over the entire axial length of the transformer winding, with a respective inner electrically conductive shield, with the result that, firstly, the capacitive properties of further turns which would be provided there without the presence of a cooling channel are approximately replicated at least partially.

Secondly, the respective shield can be configured such that the cooling function of the cooling channel is not negatively influenced, or in an ideal case is even further improved. This result can be achieved by a flat, sheet-like configuration of the respective shield, which is arranged along the axial extent of the cooling channel. In an exemplary embodiment, an alignment of the shield, even in subregions, transversely to a flow direction through the respective cooling channel should be avoided in order not to negatively influence the cooling effect. An example of this is a sheet which is to be provided, for example rolled in the form of a cylinder, in the cooling channel. Then, however, a respective aperture can be called for in certain regions of the shield in order to enable the specified spacing of the two radially adjacent winding modules there, for example by means of webs or blocks. Segmentation of a shield with a form similar to cylinder shells is also conceivable.

In an exemplary embodiment of the transformer winding according to the disclosure, the at least one cooling channel has a radially inner wall and a radially outer wall, by means of which a channel cavity is surrounded, wherein an electrical shield is arranged on at least one of the two wall sides facing the cavity. Such walls surrounding the channel cavity are firstly not unconventional in the configuration of a cooling channel, even if no additional electrical shields are provided therein. Thus, such a cooling channel can be manufactured in an advantageously simple manner by two pieces of pipe consisting of insulating material and with additional radial spacing being nested one inside the other. Secondly, during manufacture, a respective electrical shield can be provided correspondingly without any problems on at least one of the two sides facing the inner cooling channel. In this case, coating the relevant wall side with a conductive varnish material is also conceivable in addition to the application of a sheet-like shield.

In an exemplary embodiment a further arrangement of a shield, for example in the radial center of the cooling channel, has an advantageous effect for achieving capacitance distribution which is as homogeneous as possible. Such a shield fitted in the center also advantageously increases the interaction area with the cooling medium, air, flowing through the cooling channel, and the cooling effect is thus improved.

In another exemplary embodiment of the disclosure, the at least one electrical shield is galvanically connected to a radially adjacent winding layer. The configuration of the winding can have a positive effect on the potential distribution of surge voltage loading, and also on the voltage loading of the conductors in the case of steady-state operation at the system frequency.

In an exemplary embodiment of the present disclosure, a configuration having strip conductor windings with one turn per winding layer can be advantageous if the at least one electrical shield is arranged parallel to the winding axis. In this case, the potential distribution along the axial length of the winding is constant in each winding layer, and therefore the alignment of the electrical shield, which alignment is based on a potential distribution to be expected in the case of surge voltage loading, should also be selected to be parallel to the winding axis. This also can be the arrangement variant influencing the coolant flow through the cooling channel the least.

In yet another exemplary embodiment disclosed herein, a transformer includes windings with a plurality of axially adjacent turns per winding layer, and at least one electrical shield is arranged at an angle to the winding axis corresponding to an electrical potential distribution to be expected. In the case of axially adjacent winding layers, there is a potential gradient along the axial extent of the transformer winding, with this potential gradient then being accounted for by a correspondingly angled arrangement of the shield. However, this shield should be configured such that the air flow through the cooling channel is influenced as little as possible.

In another exemplary embodiment of the disclosure, a plurality of axially adjoining winding modules with a cooling channel and a flat electrical shield are provided. By virtue of such an axial segmentation, the assembly, which can include relatively large windings with a power of 10 MVA or higher, for example, is markedly simplified. Nevertheless, the cooling channels can be configured in such a way that they are guided along the common axial extent of all axially adjacent winding modules.

In accordance with an exemplary embodiment of the disclosure, a common cooling channel extends over the entire axial length of the axially adjoining winding modules, wherein at least one flat electrical shield is provided along the entire axial length of the cooling channel. As a result, the design is further simplified.

In another exemplary embodiment of the disclosure, such as two DC-isolated windings having different rated voltages are provided, a low-voltage winding and a high-voltage winding having arranged on the same coil former. The low-voltage winding, for example for a rated voltage of 10 kV, can be arranged radially on the inside and the high-voltage winding, for example for a rated voltage of 30 kV, can be arranged radially on the outside. Each of these DC-isolated windings can be constructed from winding modules with cooling channels arranged therebetween, each having an electrical shield, configured in accordance with the exemplary embodiments disclosed. The advantages of an exemplary transformer winding according to the disclosure are also afforded for a transformer with a transformer core and at least one, and in another exemplary embodiment three, transformer windings. This enables use in a three-phase power supply system.

FIG. 1 shows a plan view of a first transformer winding in accordance with an exemplary embodiment of the present disclosure. FIG. 1 shows a plan view 10 of a first exemplary transformer winding. A hollow-cylindrical first winding module 12, which comprises, for example, a plurality of layers of a strip conductor wound one on top of the other, is arranged around a common winding axis 18. This is adjoined radially on the outside by a radially inner wall 26 and a radially outer wall 28, which are spaced apart from one another radially by spacing blocks 30. The actual cooling channel 16, which is cooled during operation of the winding, for example as part of a three-phase transformer, by air flowing through from the bottom upwards, is formed between the two insulating walls 26, 28. In addition, two cylindrical electrical shields 20, 22 are indicated in the cooling channel 16, said electrical shields consisting predominantly of a suitable conductive sheet-metal material, for example. In order to be able to attach the spacing blocks 30 between the walls 26, 28, an at least partial aperture should be provided in the electrical shields 20, 22.

A second winding module 14 is radially adjacent the first winding module 12. The second winding module 14 has a plurality of layers of an electrical conductor which are not indicated in the Figures, however. An electrical series circuit of the two winding parts is indicated by a series circuit element 24, for example an aluminum profile or a conductor segment guided radially through the cooling channel. The heat output by the winding modules during operation is transmitted through the walls 26, 28 into the cooling channel 16 and also radiates in onto the electrical shields 20, 22. The air flow through the cooling channel 16 is not negatively influenced by the arrangement of the electrical shields 20, 22; even a further improved cooling effect is achieved. This is because the heat radiation also heats the two electrical shields 20, 22, which then form an increased exchange area for heat exchange with the cooling air. Of course further cooling channels which adjoin radially on the outside and further winding modules which adjoin radially on the outside are conceivable.

Figure 2:
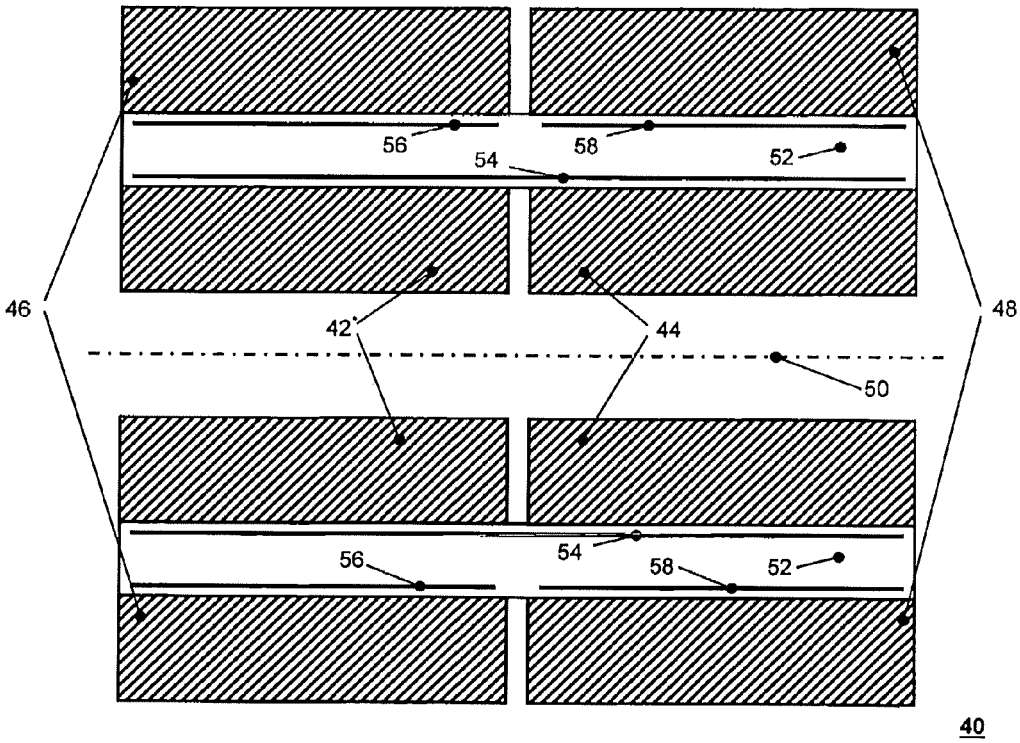
FIG. 2 shows a sectional view through a second transformer winding in accordance with an exemplary embodiment of the present disclosure.

FIG. 2 shows a sectional view through a second transformer winding in accordance with an exemplary embodiment of the present disclosure. As shown in FIG. 2, a third winding module 42 and an axially adjacent fourth winding module 44, for example with a large number of turns of an insulated copper wire, are arranged radially on the inside around a common winding axis 50. Adjacent radially on the outside is a cooling channel 52, which is guided over the entire axial length of the axially adjoining winding modules 42, 44. An electrical shield 54 is arranged in the cooling channel 52 itself radially on the inside, going beyond the axial length of the two winding modules 42, 44, wherein a shield 56, 58 split into two is arranged radially on the outside in the cooling channel 52. The two shield parts 56, 58 correspond in terms of their axial extent to the axial extent of winding modules 46, 48, which respectively adjoin the cooling channel 52 radially on the outside and adjoin one another axially. All four winding modules 42, 44, 46, 48 are connected electrically in series. Depending on the nature of the series circuit or also corresponding to the structural boundary conditions, splitting the radially outer shield in two to form a first shield part 56 and a second shield part 58 can be expedient. In the context of the present disclosure, it should be understood that all radially inner winding modules 42, 44 are connected in series and then there is a series connection with the radially outer winding modules 46, 48.

Figure 3:
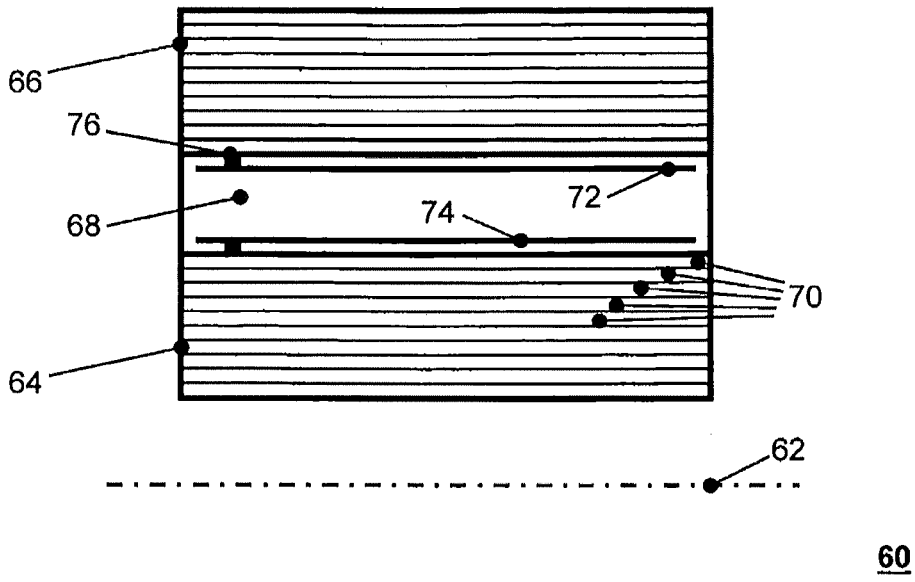
FIG. 3 shows a partial sectional view through a third transformer winding in accordance with an exemplary embodiment of the present disclosure.

FIG. 3 shows a partial sectional view through a third transformer winding in accordance with an exemplary embodiment of the present disclosure. As shown in FIG. 3, a radially inner hollow-cylindrical seventh winding module 64 is arranged around a common winding axis 62, which seventh winding module 64 is adjoined radially on the outside by a hollow-cylindrical cooling channel 68 and a hollow-cylindrical eighth winding module 68. The two winding modules 64, 66 are indicated as a strip conductor winding with a single turn of a strip conductor 70 per winding layer and with a plurality of winding layers. Two electrical shields 72, 74, which extend parallel to the winding axis 62 and along substantially the entire axial length of the winding modules 64, 66, are indicated in the interior of the cooling channel 68. Owing to the constant potential distribution to be expected in the strip conductor 70 along its axial extent, the electrical shields 72, 74 likewise should to be arranged parallel to one another, wherein both shields 72, 74 are galvanically connected to the respective adjoining layer of the strip conductor 70 via connecting elements 76. As a result, the radial interspace between the two strip conductor turns surrounding the cooling channel 68 radially is reduced electrically, whereby an increase in the capacitance is achieved.

Figure 4:
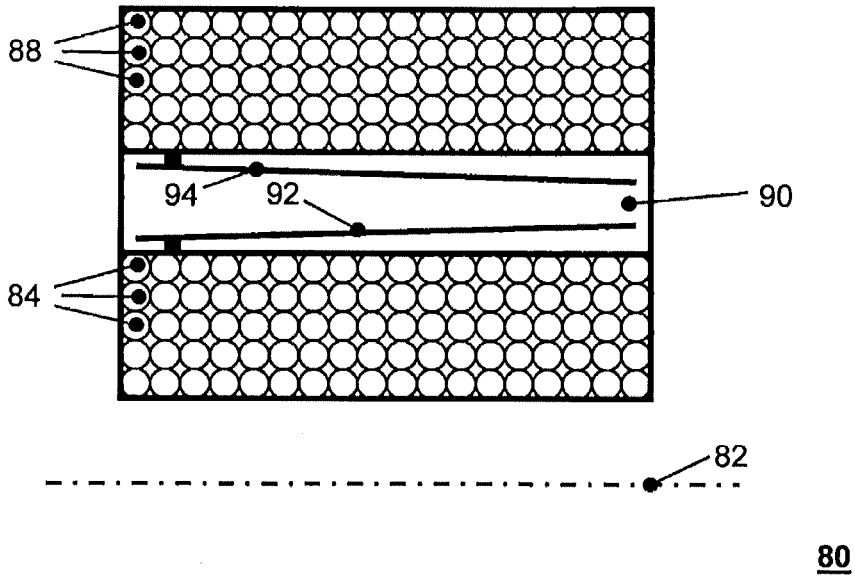
FIG. 4 shows a partial sectional view through a fourth transformer winding in accordance with an exemplary embodiment of the present disclosure.

FIG. 4 shows a partial sectional view through a fourth transformer winding in accordance with an exemplary embodiment of the present disclosure. As shown in FIG. 4, two hollow-cylindrical winding modules which are nested one inside the other are arranged around a common winding axis 82, wherein a winding layer now includes a plurality of adjoining turns 84 or 88 of a round conductor. A cooling channel 90 with two electrical shields 92, 94 is arranged radially between the winding modules. Owing to the plurality of turns per winding layer, a potential distribution which is constant along the axial extent of the turn modules cannot be expected in the case of surge voltage loading. Therefore, the electrical shields 92, 94 are arranged at a slight angle, for example 1°-10° to the winding axis 82, in order thus to ensure a voltage distribution which is as homogeneous as possible. The arrangement of winding modules and cooling channels around a common axis of rotation does are not specified to be circular; with respect to transformer limbs which are possibly only approximately circular, it is possible to correspondingly match the shape of the winding and if necessary to bring it close to a rectangle.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Plan view of a first exemplary transformer winding
12 First winding module
14 Second winding module
16 First cooling channel
18 Winding axis
20 First electrical shield
22 Second electrical shield
24 Electrical series circuit
26 Radially inner wall
28 Radially outer wall
30 Spacing
40 Sectional view through a second exemplary transformer winding
42 Third winding module
44 Fourth winding module
46 Fifth winding module
48 Sixth winding module
50 Winding axis
52 Second cooling channel
54 Third electrical shield
56 Fourth electrical shield
58 Fifth electrical shield
60 Partial sectional view through a third exemplary transformer winding
62 Winding axis
64 Seventh winding module
66 Eighth winding module
68 Third cooling channel
70 Strip conductor of seventh winding module
72 Sixth electrical shield
74 Seventh electrical shield
76 Galvanic connection to the electrical shield
80 Partial sectional view through a fourth exemplary transformer winding
82 Winding axis
84 Electrical conductor turns of eighth winding module
88 Electrical conductor turns of ninth winding module
90 Fourth cooling channel
92 Eighth electrical shield
94 Ninth electrical shield

What is claimed is:

1. A power transformer winding, comprising:

at least two multi-layered winding modules of the power transformer, which are connected electrically in series, extend about a common winding axis, and are nested one inside the other hollow-cylindrically;

at least one cooling channel, which is arranged along the common winding axis hollow-cylindrically between the winding modules; and a flat electrical shield is provided within the at least one cooling channel at least sectionally along the radial circumference thereof, wherein the electrical shield extends over approximately the entire axial length and through which electrical shield the electrical capacitance distribution in the transformer winding connected electrically in series is influenced.

2. The transformer winding as claimed in claim 1, wherein the cooling channel has a radially inner wall and a radially outer wall, by means of which a channel cavity is surrounded, and a second electrical shield is arranged on at least one of the two wall sides facing the cavity.

3. The transformer winding as claimed in claim 1, wherein at least one third electrical shield is galvanically connected to a radially adjacent winding layer.

4. The transformer winding as claimed in claim 1, wherein the transformer winding is a strip conductor winding with one turn per winding layer, and the at least one third electrical shield is arranged in parallel with the winding axis.

5. The transformer winding as claimed in claim 1, wherein the winding modules are designed to have a plurality of axially adjacent turns per winding layer, and the at least one electrical shield is arranged at an angle to the winding axis corresponding to an electrical potential distribution to be expected.

6. The transformer winding as claimed in claim 1, wherein a plurality of axially adjoining winding modules with a cooling channel and a flat electrical shield are provided.

7. The transformer winding as claimed in claim 6, wherein at least one common cooling channel extends over the entire axial length of the axially adjoining winding modules, and the at least one flat electrical shield is provided along the entire axial length of the cooling channel.

8. The transformer winding as claimed in claim 1, comprising:

two DC-isolated windings having different rated voltages.

9. A transformer, comprising a transformer core and at least one transformer winding as claimed in claim 8.

10. A power transformer winding, comprising:

a plurality of multi-layered winding modules of the power transformer connected electrically in series, each winding module is formed as first hollow-cylinders extending about a common winding axis, wherein a first winding module is nested inside a second winding module;

at least one cooling channel, which is arranged in a second hollow-cylinder along the common winding axis and between the first and second winding modules; and a flat electrical shield is provided within the at least one cooling channel and at least sectionally along a radial circumference of the at least one cooling channel, wherein the electrical shield extends over approximately an entire axial length of the at least one cooling channel and influences the electrical capacitance distribution in the series-connected winding modules.

11. The transformer winding as claimed in claim 10, wherein the at least one cooling channel has a channel cavity established between a radially inner wall and a radially outer wall, and a second electrical shield is arranged on at least one of the inner and outer wall sides facing the cavity.

12. The transformer winding as claimed in claim 10, wherein at least one third electrical shield is galvanically connected to a radially adjacent winding layer.

13. The transformer winding as claimed in claim 10, wherein the transformer winding is a strip conductor winding with one turn per winding layer, and the at least one third electrical shield is arranged parallel to the winding axis.

14. The transformer winding as claimed in claim 10, wherein the winding modules are configured to include a plurality of axially adjacent turns per winding layer, and the at least one electrical shield is arranged at an angle to the winding axis corresponding to an expected electrical potential distribution.

15. The transformer winding as claimed in claim 10, wherein the first and second winding modules are axially adjoined, and the at least one cooling channel extends over an entire axial length of the axially adjoining winding modules, and the at least one flat electrical shield is provided along the entire axial length of the at least one cooling channel.

16. The transformer winding as claimed in claim 10, wherein the plurality of multi-layered winding modules includes at least two DC-isolated windings having different rated voltages.

* * * * *